US007121894B2

(12) United States Patent
Lin

(10) Patent No.: US 7,121,894 B2
(45) Date of Patent: Oct. 17, 2006

(54) CARD CONNECTOR

(75) Inventor: Jacky Lin, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 11/062,859

(22) Filed: Feb. 23, 2005

(65) Prior Publication Data

US 2006/0189186 A1 Aug. 24, 2006

(51) Int. Cl.
*H01R 24/00* (2006.01)

(52) U.S. Cl. ..... 439/630; 439/633

(58) Field of Classification Search ..... 439/630, 439/633, 677, 680; 235/492
See application file for complete search history.

(56) References Cited

U.S. PATENT DOCUMENTS 5,036,430 A * 7/1991 Hills ..... 361/684
6,666,724 B1 * 12/2003 Lwee ..... 439/630
6,717,805 B1 * 4/2004 Liu et al. ..... 361/684
6,749,450 B1 * 6/2004 Chen ..... 439/188
6,761,320 B1 * 7/2004 Chen ..... 235/492
6,835,100 B1 * 12/2004 Chen ..... 439/630
6,908,321 B1 * 6/2005 Lai ..... 439/140

* cited by examiner

*Primary Examiner*—Thanh-Tam Le
(74) *Attorney, Agent, or Firm*—Troxell Law Office, PLLC

(57) ABSTRACT

A card connector is compatible with different types of memory cards. The card connector has an insulative frame and a plurality of conductive terminals received in the insulative frame. The insulative frame has a plug portion defining a plurality of slots for receiving different memory cards. The card connector has an anti-misplug mechanism mounted on the insulative frame. The anti-misplug mechanism includes a pressing pate and a spring strip. The pressing plate has an end pivotably received in the insulative frame and a stop portion stopping one of the slots in assembly. The spring strip is mounted below the pressing plate for providing returning force. When a card is received in one of slots in the insulative frame, the stop portion stops other slots of the insulative frame, thereby avoiding insertion of other memory cards into the card connector by mistake.

13 Claims, 7 Drawing Sheets

CARD CONNECTOR

BACKGROUND OF THE INVENTION

1. Field of the Invention

The present invention relates to a card connector, and particularly to a card connector which is compatible for multi-type cards, for example, Compact Flash (CF) Card, Secure Digital (SD) Card, Multimedia Card (MMC), Smart Media (SM) Card and XD-picture Card, and which prevents simultaneous plug of multiple cards.

2. Related Art

Memory cards are of more capability and smaller size, and are popularly used. Nowadays people often hold multi-type memory cards. For meeting this tendency, card connectors are designed to be used with different type memory cards. Such a card connector is easily used and costs down. The card connector forms multiple accommodation slots for receiving different memory cards, respectively.

Users often simultaneously plug multiple cards to a card connector by mistake. Sometimes, a card is left in the card connector, and another card is inserted into the card connector at the same time. This tends to damage main board or result in failure of signal transmission.

SUMMARY OF THE INVENTION

Accordingly, an object of the present invention is to provide a card connector which prevents simultaneous plug of multiple cards and assures reliable data transmission.

The card connector comprises an insulative frame, a plurality of conductive terminals received in the insulative frame, and an anti-misplug mechanism mounted on the insulative frame. The anti-misplug mechanism includes a pressing pate and a spring strip. The pressing plate has an end pivotably received in the insulative frame and a stop portion stopping one of the slots of the insulative frame in assembly. The spring strip is mounted below the pressing plate for providing returning force. When a card is inserted into one of slots in the insulative frame, the card presses the stop portion to move until the stop portion stops other slots of the insulative frame, thereby avoiding insertion of other memory cards into the card connector by mistake. On the contrary, when a card is received in one of the slots, the card stops the stop portion moving, and therefore another card cannot be inserted into another slot.

DESCRIPTION OF THE PREFERRED EMBODIMENTS

Figure 1:
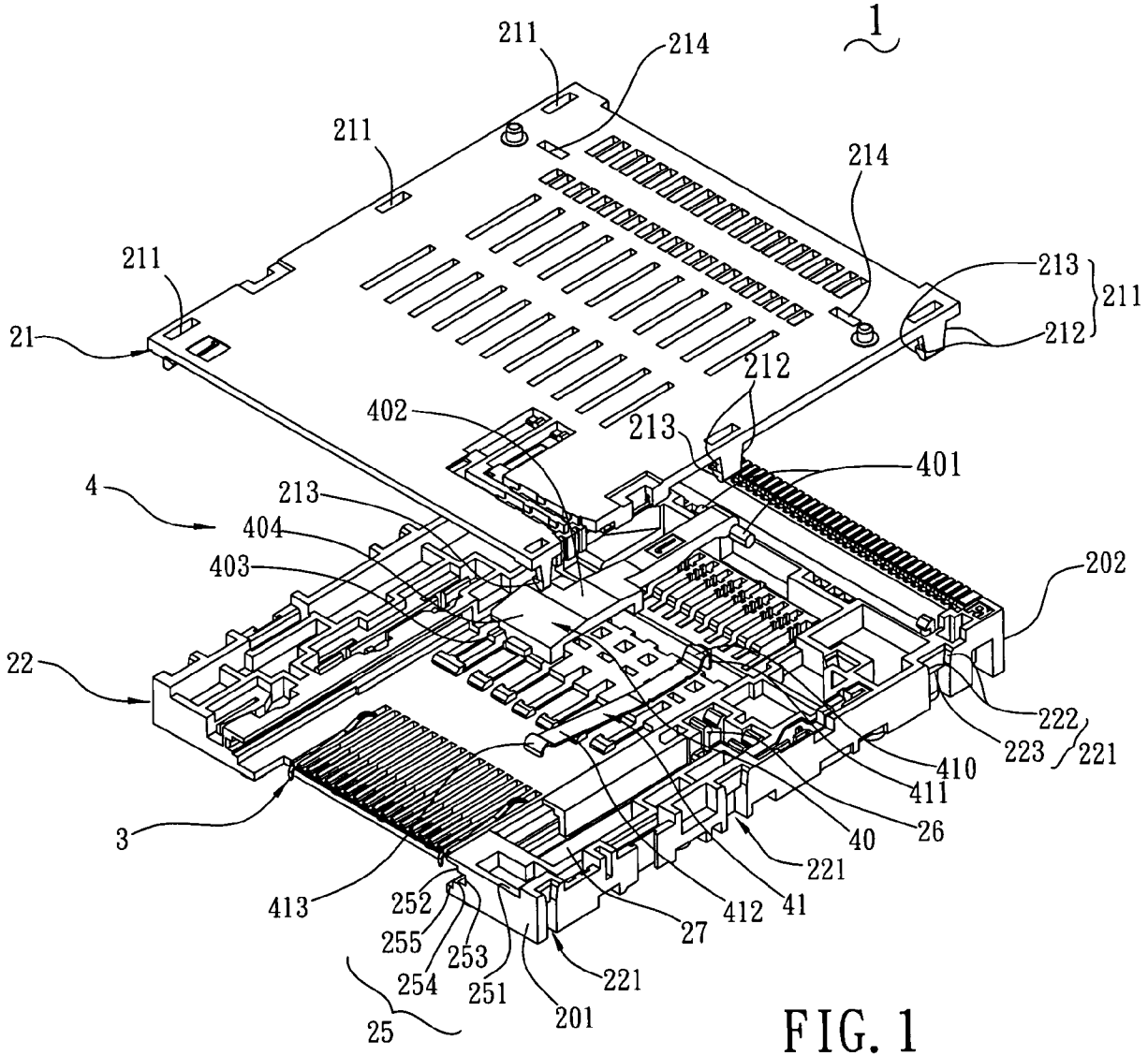
FIG. 1 is an exploded view of a card connector of the present invention.
Figure 2:
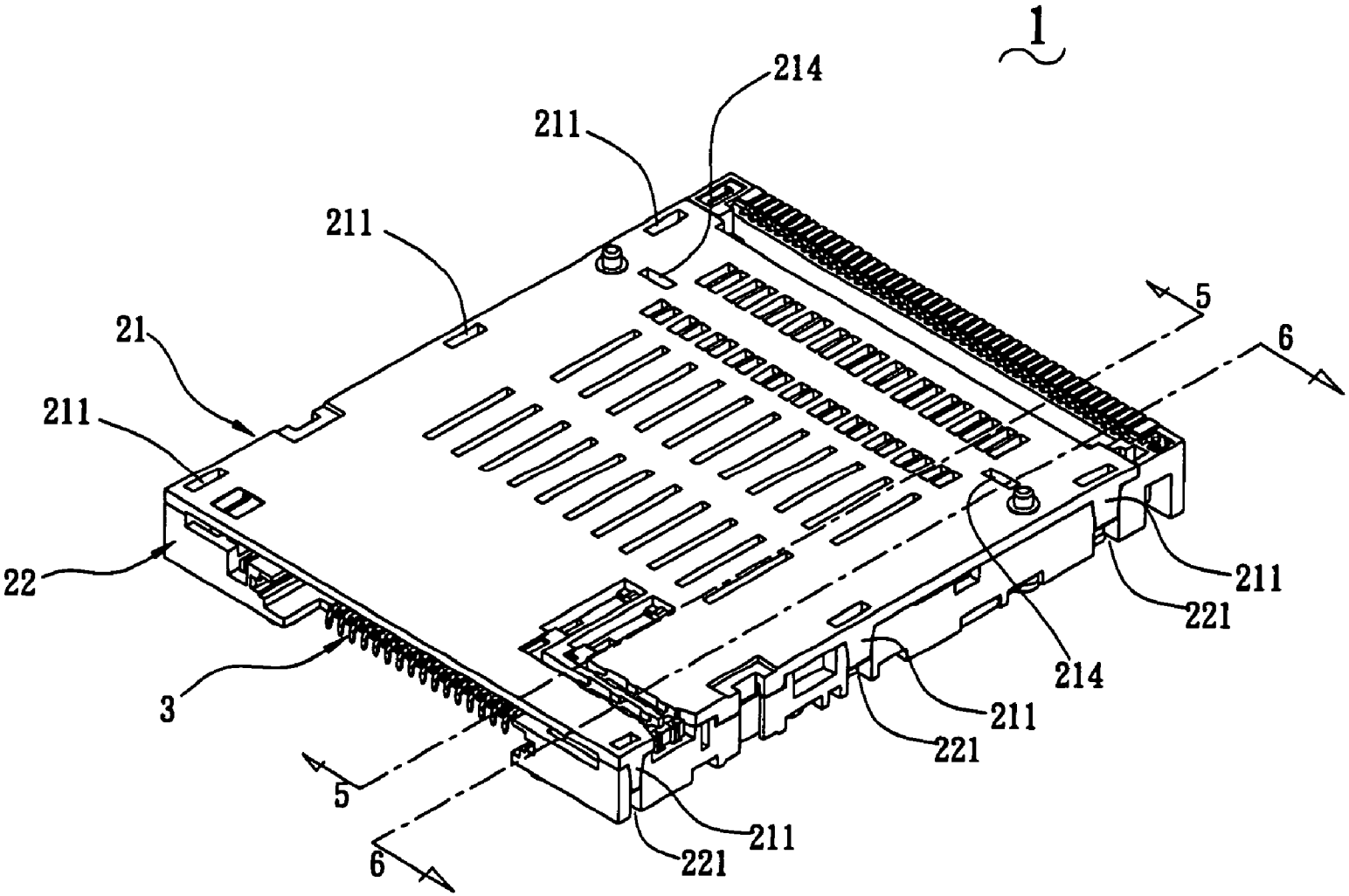
FIG. 2 is an assembled view of the card connector of FIG. 1.
Figure 3:
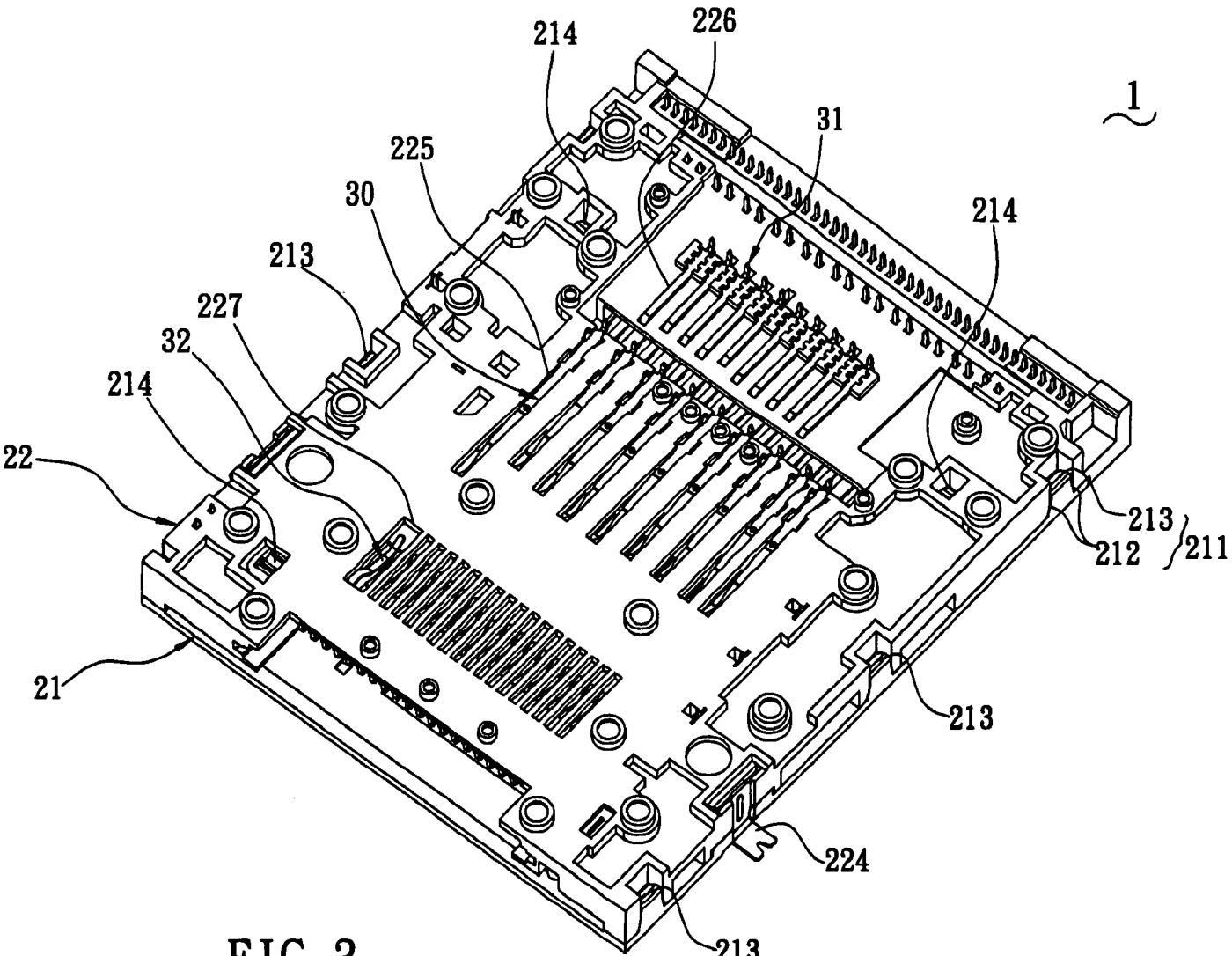
FIG. 3 is an assembled view of the card connector, wherein the card connector is rotated at 180°.

With reference to FIGS. 1 and 2, a card connector 1 of the present invention comprises an insulative frame 2, a plurality of different conductive terminals 3 received in the insulative frame 2 for contacting different memory cards (not shown), and an anti-misplug mechanism 4. The insulative frame 2 is flat and rectangular, and forms a mating side 201 and a soldering side 202 opposite to each other. The mating side 201 defines a plug portion 25 for accommodating different memory cards. The plug portion 25 defines a plurality of slots, including a first slot 251 for receiving an SM card, a second slot 252 for receiving an SD card, a third slot 253 for receiving an MMC card, a fourth slot 254 for receiving a CF card, and a fifth slot 255 for receiving an XD card, which are arranged from top to bottom. The second, third, fourth and fifth slot 252, 253, 254, 255 are of similar thickness. That is, each slot can accommodate nothing but one memory card. The insulative frame 2 includes an upper frame 21 and a lower frame 22 assembled together for receiving a memory card (not shown) therebetween. The upper frame 21 downwardly forms a plurality of lock portions 211, which are distributed along longitudinal sides thereof. As shown in FIG. 1, three lock portions 211 are formed along each longitudinal side of the upper frame 21. Each lock portion 211 includes a retention portion 212 and an anchor portion 213. The retention portion 212 depends inwardly and downwardly from an edge of the longitudinal sides of the upper frame 21. The anchor portion 213 inwardly bends and downwardly extends from a lower end of the retention portion 212. The lower frame 22 defines embedding portions 221 at opposite longitudinal sides thereof for engaging with the lock portions 211. As shown in FIG. 1, three embedding portions 221 are defined along each longitudinal side of the lower frame 22. Each embedding portion 221 has a guiding portion 222 and an abutting portion 223. The guiding portion 222 is defined adjacent an edge of longitudinal sides of the lower frame 22 and forms inclined surface for guiding the retention portion 212 of the lock portion 211. The abutting portion 223 extends from the guiding portion 222 and is slightly narrower than the guiding portion 222 for receiving the anchor portion 213 of the lock portion 211. The upper frame 21 downwardly forms a pair of hooks 214, which are distributed along a transverse side thereof. Arrangement of the hooks 214 is substantially perpendicular to arrangement of the lock portions 211 for enhancing assembly of the upper frame 21 and the lower frame 22. Further referring to FIG. 3, to disengage the upper frame 21 and the lower frame 22, only a tool (not shown), for example, a screwdriver, is needed to push the anchor portions 213 and the anchors 214 outwardly, thereby simplifying assembly and lifting manufacture and maintenance efficiency. The lower frame 22 defines a plurality of passageways, which are divided into different types, including first passageways 225, second passageways 226 and third passageways 227 for respectively receiving different types of terminals 3. The terminals 3 include first terminals 30, second terminals 31 and third terminals 32. Notably, combining with FIGS. 4A and 4B, the first passageways 225 are located in substantial middle of the passageways. Each first passageway 225 has a buffer section 2251 and an interference section 2252 for facilitating mounting of the first terminals 30. Each first terminal 30 includes a contact portion 301 at an end thereof, a solder portion 303 at an opposite end thereof, and an intermediate portion 302 between the contact portion 301 and the solder portion 303.

Figure 4A:
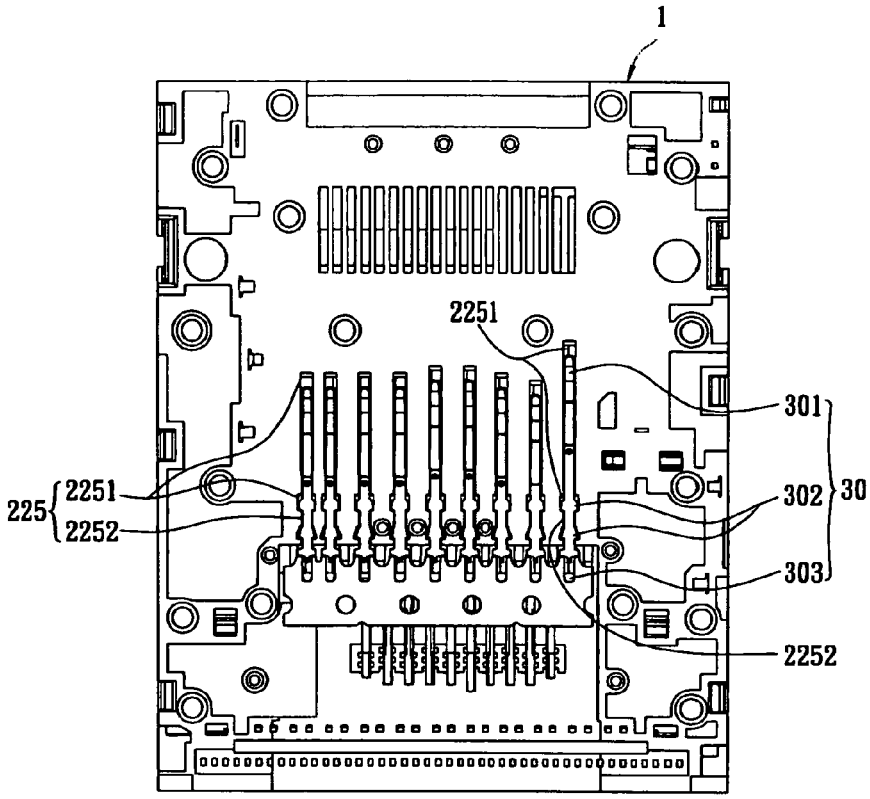
FIGS. 4A and 4B schematically show conductive terminals of the card connector being assembled thereto.
Figure 4B:
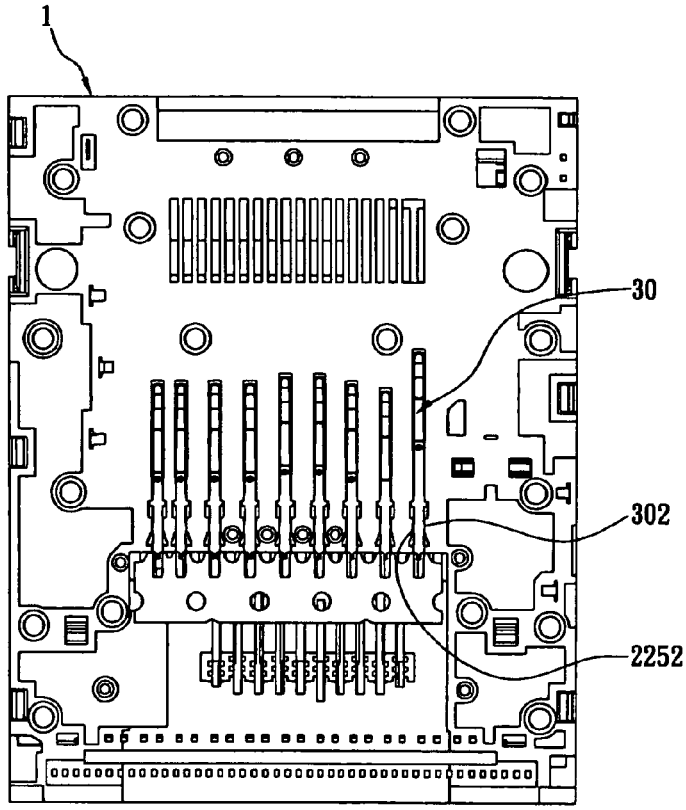

The intermediate portions 302 and the contact portions 301 are movable in the buffer sections 2251 of the first passageways 225. In assembly, the first terminals 30 are inserted from a bottom of the lower frame 22. The intermediate portions 302 and the contact portions 301 are received in the buffer sections 2251, as shown in FIG. 4A. Then the first terminals 30 moves along the buffer sections 225 until the intermediate portions 302 interferentially engage with the interferential sections 2252, as shown in FIG. 4B. Thus the first terminals 30 are firmly mounted on the first passageways 251 of the lower frame 22.

The anti-misplug mechanism 4 is mounted on the insulative frame 2. The anti-misplug mechanism 4 includes a pressing plate 40 and a spring strip 41. The pressing plate 40 has a fixed fulcrum lever 401 at an end thereof and a stop portion 402 extends substantially perpendicular to the fulcrum lever 401 for stopping one of the slots of the plug portion 25. The insulative frame 2 forms a base 26 for pivotably receiving the fulcrum lever 401. A plurality of contour blocks 403 are formed on an end of the stop portion 402 and correspond to the first slot 251, the second slot 252, the third slot 253, the fourth slot 254 and the fifth slot 255. The insulative frame 2 further forms a cavity 27 for receiving the contour blocks 403 of the pressing plate 40. Notably, in assembly the contour blocks 403 of the pressing plate 40 are aligned to the first slot 251, the second slot 252, the third slot 253, the fourth slot 254 and the fifth slot 255 for allowing selective plugging of memory cards. The stop portion 402 forms a guiding surface 404 at upper of the contour blocks 403 for guiding insertion of memory cards.

Figure 5:
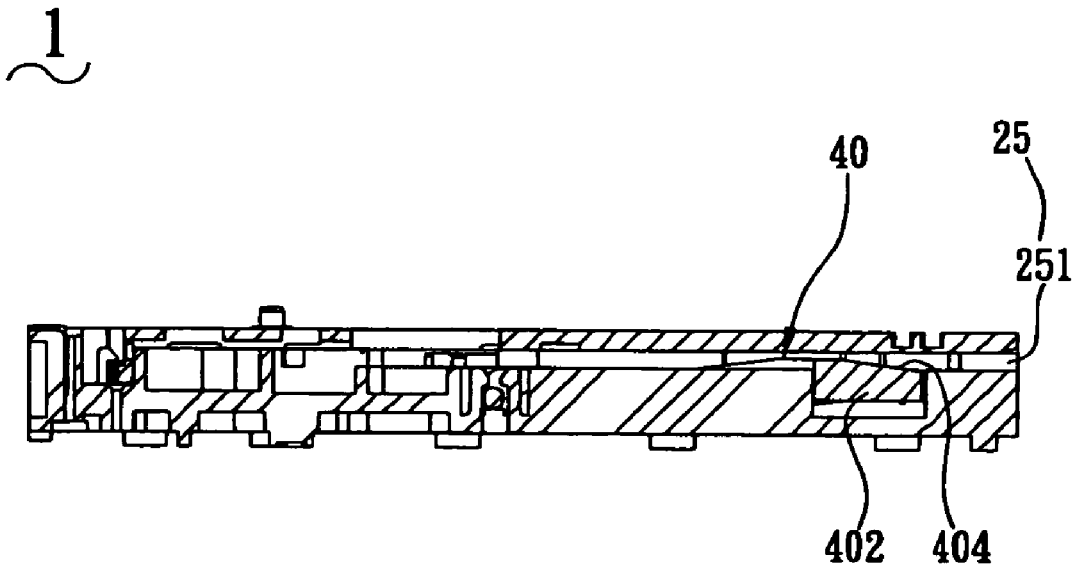
FIG. 5 is a cross-sectional view taken along 5—5 of FIG. 2.
Figure 6:
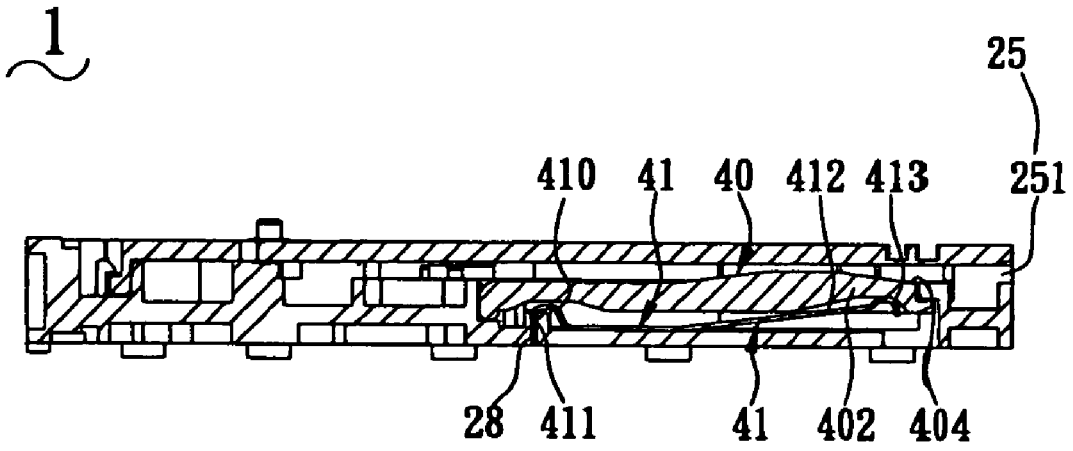
FIG. 6 is a cross-sectional view taken along 6—6 of FIG. 2.

The spring strip 41 is mounted below the pressing plate 40 for providing returning force. The spring strip 41 has a first bended portion 410 at an end thereof, and a connecting portion 412 extending slightly upwardly from the first bended portion 410. The connecting portion 412 forms a second bended portion 413 at an end thereof and opposite to the first bended portion 410. The first bended portion 410 forms an arcuate portion 411, which is received in an assembling groove 28 of the insulative frame 2 in assembly. Referring to FIG. 5, the spring strip 41 upwardly presses the stop portion 402 of the pressing plate 40 against the first slot 251. The second bended portion 413 has an arc shape for further pressing the pressing plate 40.

Figure 7:
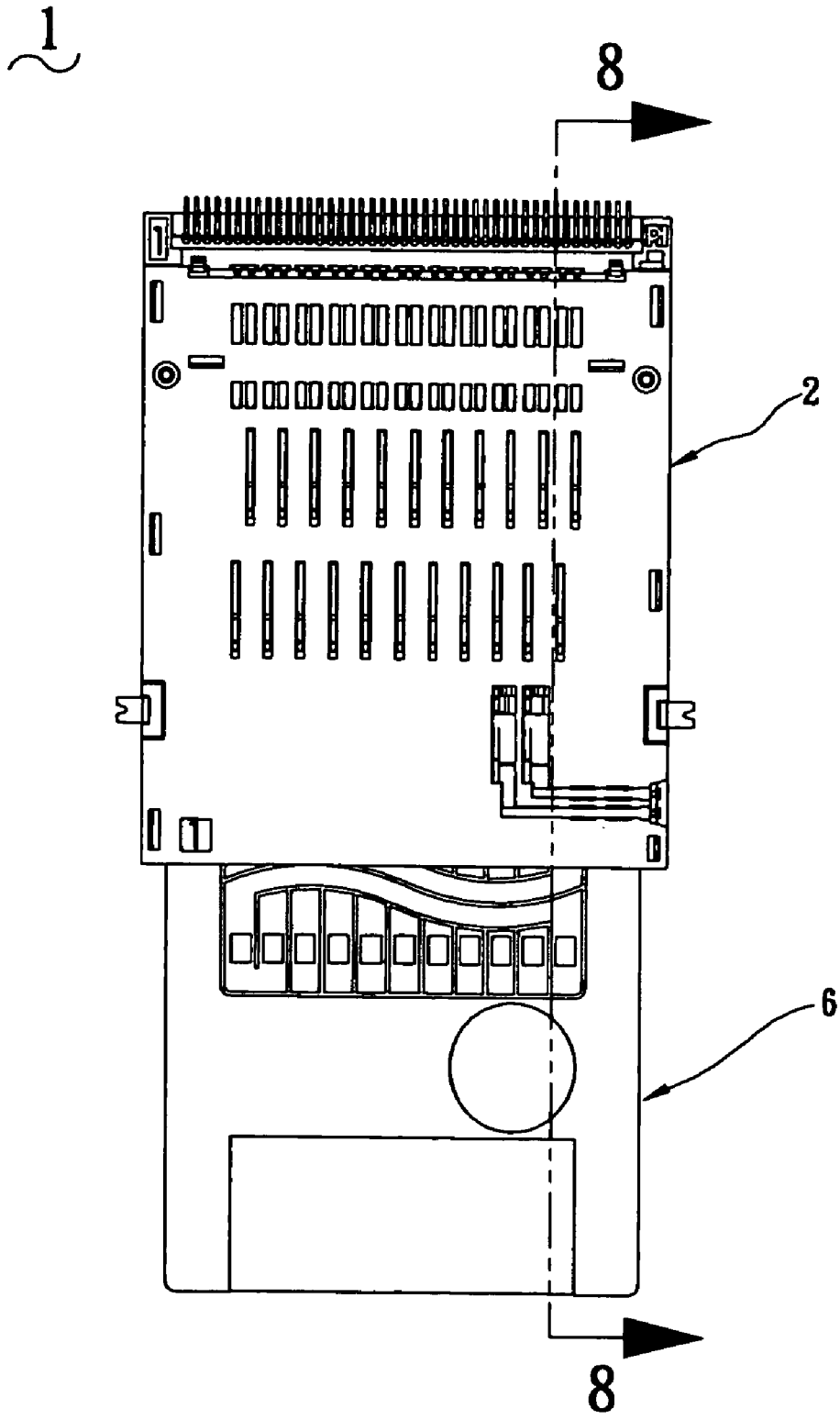
FIG. 7 is a top view of the card connector with an SM card inserted therein.
Figure 8:
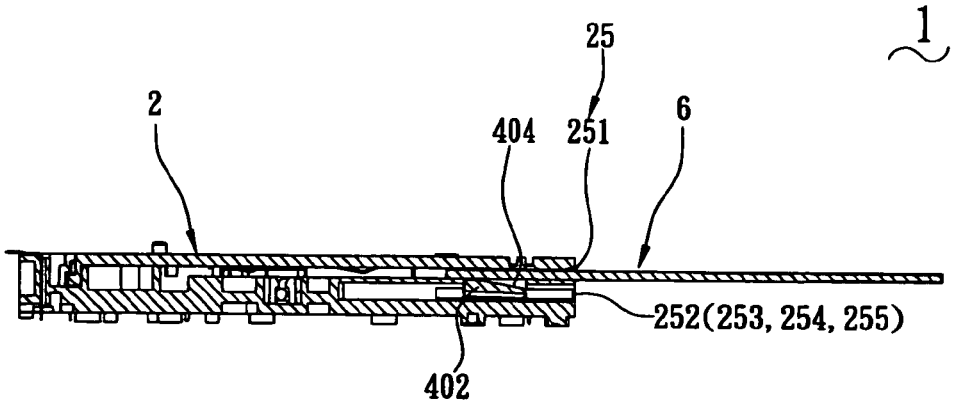
FIG. 8 is a cross-sectional view taken along 8—8 of FIG. 7.
Figure 9:
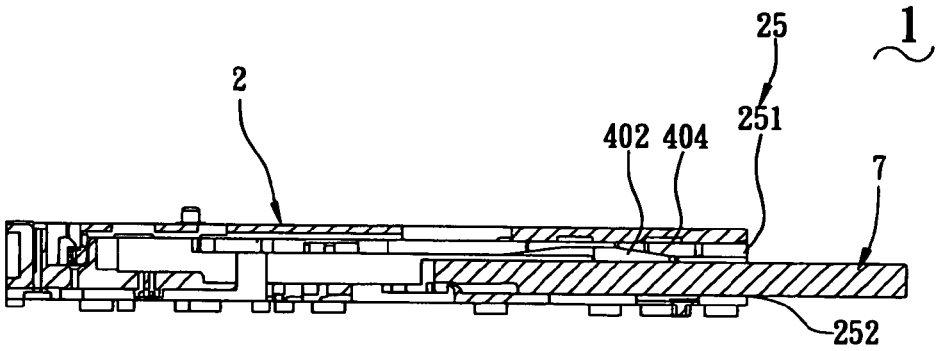
FIGS. 9 and 10 are cross-sectional views of the card connector with an SD card or an XD card inserted thereinto.
Figure 10:
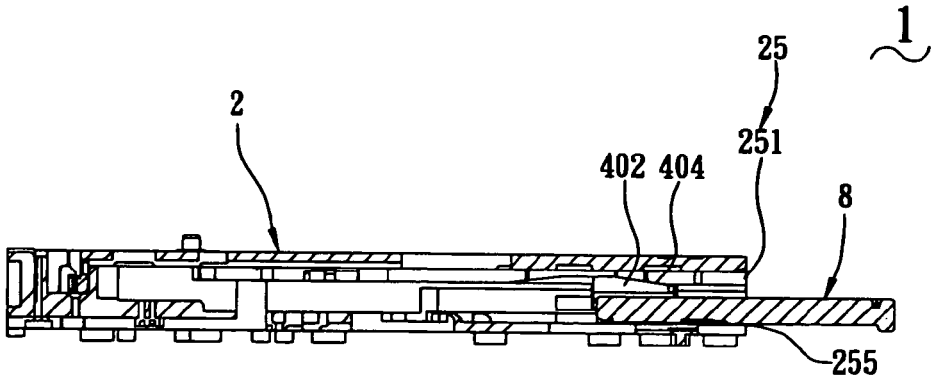

Referring to FIGS. 7 and 8, an SM card 6 is guided by the guiding surface 404 of the stop portion 402, and is inserted into the first slot 251. The SM card 6 presses the stop portion 402 downwardly, and at the same time the stop portion 402 stops the second slot 252, the third slot 253, the fourth slot 254 and the fifth slot 255, avoiding insertion of other memory cards, for example, an SD card, an MMC card, a CF card or an XD card into the card connector 1 by mistake. Referring to FIG. 9, when an SD card 7 is received in the second slot 252, the SD card 7 stops the stop portion 402 to move downwardly, and therefore an SM card cannot be inserted into the first slot 251. Similarly, as shown in FIG. 10, when an XD card 8 is received in the fifth slot 255, the XD card 8 stops the stop portion 402 to move, and therefore an SM card cannot be inserted into the first slot 25. Regardless of insertion of any memory card into the card connector 1, other memory card cannot be inserted into the card connector 1 any more. So it is only one memory card that is received in the card connector 1 for data transmission.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. A card connector, adapted for different types of memory cards, comprising:

an insulative frame having a mating side and a soldering side opposite to each other, the mating side defining a plug portion for accommodating different memory cards, the plug portion including a plurality of slots;

a plurality of different conductive terminals received in the insulative frame for contacting different memory cards; and an anti-misplug mechanism mounted on the insulative frame, and including a pressing plate and a spring strip, the pressing plate having an end pivotably received in the insulative frame and a stop portion stopping one of the slots of the plug portion in assembly, the spring strip being mounted below the pressing plate for providing returning force.

2. The card connector as claimed in claim 1, wherein the slots of the plug portion includes a first slot for receiving a Smart Media card, a second slot for receiving a Secure Digital card, a third slot for receiving a Multimedia card, a fourth slot for receiving a Compact Flash card, and a fifth slot for receiving an XD-picture card, which are arranged from top to bottom.

3. The card connector as claimed in claim 2, wherein the pressing plate has a fixed fulcrum lever at an end thereof, and the insulative frame forms a base for pivotably receiving the fulcrum lever.

4. The card connector as claimed in claim 3, wherein the stop portion extends substantially perpendicular to the fulcrum lever, and wherein a plurality of contour blocks are formed on an end of the stop portion and correspond to the first slot, the second slot, the third slot, the fourth slot and the fifth slot, and the insulative frame further forms a cavity for receiving the contour blocks.

5. The card connector as claimed in claim 4, wherein the spring strip has a first bended portion at an end thereof and a connecting portion extending slightly upwardly from the first bended portion, the first bended portion forming an arcuate portion which is received in an assembling groove of the insulative frame in assembly.

6. The card connector as claimed in claim 5, wherein the connecting portion forms a second bended portion at an end thereof and opposite to the first bended portion, the second bended end having an arc shape for firmly pressing the pressing plate.

7. the card connector as claimed in claim 4, wherein the stop portion forms a guiding surface at upper of the contour blocks for guiding insertion of a memory card.

8. the card connector as claimed in claim 1, wherein the insulative frame includes an upper frame and a lower frame assembled together for receiving a memory card therebetween; wherein the upper frame downwardly forms lock portions which are distributed along longitudinal sides thereof, each lock portion including a retention portion and an anchor portion; and wherein the lower frame defines embedding portions at opposite longitudinal sides thereof for engaging with the lock portions, each embedding portion having a guiding portion and an abutting portion.

9. The card connector as claimed in claim 8, wherein the upper frame downwardly forms a pari of hooks which are distributed along a transverse side thereof, and wherein arrangement of the hooks is substantially perpendicular to arrangement of the lock portions for enhancing assembly of the upper frame and the lower frame.

10. the card connector as claimed in claim 8, wherein the retention portion depends inwardly and downwardly from an edge of the longitudinal sides of the upper frame.

11. The card connector as claimed in claim 10, wherein the anchor portion inwardly bends and downwardly extends from a lower end of the retention portion.

12. The card connector as claimed in claim 8, wherein the guiding portion is defined adjacent an edge of longitudinal sides of the lower frame and forms an inclined surface for guiding engagement of the retention portion of the lock portion.

13. The card connector as claimed in claim 12, wherein the abutting portion extends from the guiding portion and is slightly narrower than the guiding portion for receiving the anchor portion of the lock portion.

* * * * *